US007182570B2

(12) United States Patent
Favret et al.

(10) Patent No.: US 7,182,570 B2
(45) Date of Patent: Feb. 27, 2007

(54) CENTRIFUGAL PUMP

(75) Inventors: Ugo Favret, Casarsa (IT); Silvano Cimetta, Treviso (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 10/502,873

(22) PCT Filed: Jan. 20, 2003

(86) PCT No.: PCT/EP03/00474

§ 371 (c)(1),
(2), (4) Date: Mar. 31, 2005

(87) PCT Pub. No.: WO03/072947

PCT Pub. Date: Sep. 4, 2003

(65) Prior Publication Data

US 2005/0175455 A1 Aug. 11, 2005

(30) Foreign Application Priority Data

Feb. 26, 2002 (IT) ..... PN20020012 U

(51) Int. Cl.
*F04D 29/22* (2006.01)

(52) U.S. Cl. ..... 415/106; 416/236 R

(58) Field of Classification Search ..... 415/104, 415/106; 416/235, 236 R, 245 R; 417/365
See application file for complete search history.

(56) References Cited

U.S. PATENT DOCUMENTS

| | | | | |
|---|---|---|---|---|
| 3,135,211 A * | 6/1964 | Pezzillo | 417/357 |
| 5,156,522 A * | 10/1992 | Tessier | 415/58.2 |
| 5,290,236 A | 3/1994 | Mathewson | 604/131 |
| 5,441,535 A * | 8/1995 | Takahashi et al. | 623/3.13 |
| 5,542,817 A * | 8/1996 | Brandt | 415/58.2 |

FOREIGN PATENT DOCUMENTS

| | | |
|---|---|---|
| DE | 100 21 057 A | 11/2001 |
| EP | 0 599 138 A | 6/1994 |
| WO | 99/39105 A | 8/1999 |

* cited by examiner

*Primary Examiner*—Edward K. Look
*Assistant Examiner*—Nathan Wiehe
(74) *Attorney, Agent, or Firm*—Pearne & Gordon LLP

(57) ABSTRACT

Centrifugal pump, in particular drain pump for washing machines, comprising a casing (10) that defines a chamber (11) within which an impeller formed by a hub (14) and a disk (15) provided with blades (16) is capable of rotating. The impeller is provided with at least a slit (20) adapted to generate a negative pressure on the rear surface of the disk (15) during the rotation of said impeller.
The solution is very simple and rational; it enables a clogging of the impeller, as it may be caused by the presence of foreign matters and bodies in the washing liquor, to be avoided. It also enables axial thrusts, as they occur during the rotation of the impeller, to be compensated for.

1 Claim, 2 Drawing Sheets

CENTRIFUGAL PUMP

This application claims the benefit of International Application Number PCT/EP03/00474, which was published in English on Sep. 4, 2003.

The present invention refers to a centrifugal pump provided with an improved impeller, in particular a drain pump for clothes washing machines, clothes driers and similar appliances.

As largely known in the art, pumps of the above cited are not required to ensure any significant performance in operation, but must in any case be extremely low-cost items.

The impeller in the simplest pump designs is formed by a hub and an array of radial blades, usually in the number of four. This type of impeller has a drawback in that, under operating conditions, it can collect and retain various kinds of foreign matters and impurities, thereby losing a great deal of its efficiency. This occurs especially when the pumps are used in clothes washing machines, due to the formation of lint that gradually winds up round the hub of the impeller with the result of eventually clogging the water passage cross-section area thereof.

In view of doing away with such a drawback of the pumps provided with simply bladed impellers that are so easily clogged by lint, impellers have been developed in which the hub is firmly joined to a disk on which the blades are then either attached or provided integrally therewith. However, this solution has a different kind of drawback. In fact, the rotation of the impeller that forces the water from the intake side to the delivery side creates a hydraulic pressure difference between the two mutually opposing faces of the bladed disk, owing mainly to the different size of the surfaces involved by the thrust exerted by the water. In other words, the pressure on the front surface of the disk is smaller than the pressure exerted on the back surface. As a result, the impeller turns out to be undesirably stressed by a strong axial thrust towards the intake side. In order to compensate for such a thrust, through-holes, i.e. perforations can be made in an axial direction in the disk, but this solution fails to prove satisfactory, owing to the fact that even such perforations are easily subject to clogging due to the passage of dirty water therethrough.

It therefore is a purpose of the present invention to provide a centrifugal pump with an improved impeller which, while being most simple and low-cost in its construction, is effective in avoiding getting clogged under operating conditions and is therefore capable to preserve and ensure its full efficiency over time. Furthermore, the pump according to the present invention does practically away with the problem brought about by the above mentioned axial thrust exerted on the impeller.

According to the present invention, this aim is reached in a pump having the characteristics as recited and defined in the appended claims.

Anyway, features and advantages of the present invention will be more readily understood from the description that is given below by way of non-limiting example with reference to the accompanying drawings, in which.

Figure 1:
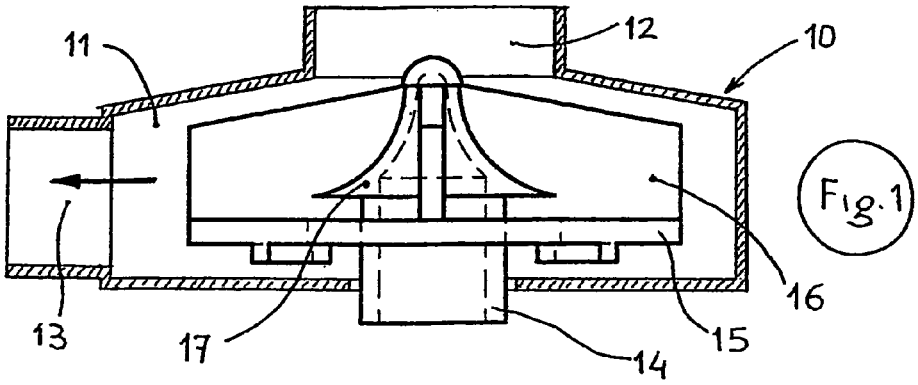
FIG. 1 is a schematic side view of a first embodiment of a pump with the impeller according to the present invention.
Figure 2:
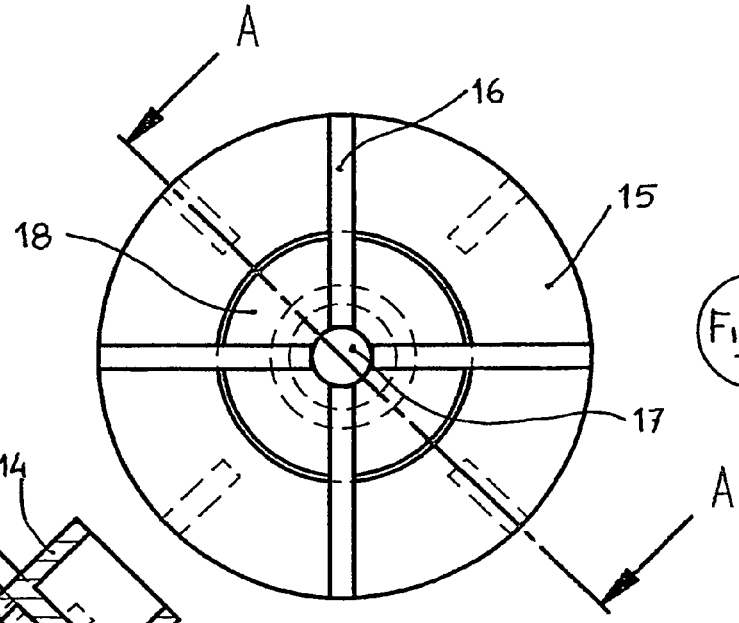
FIGS. 2 to 4 are a schematic front view, a schematic cross-sectional view and a schematic perspective view, respectively, of the impeller of the pump illustrated in FIG. 1.
Figure 3:
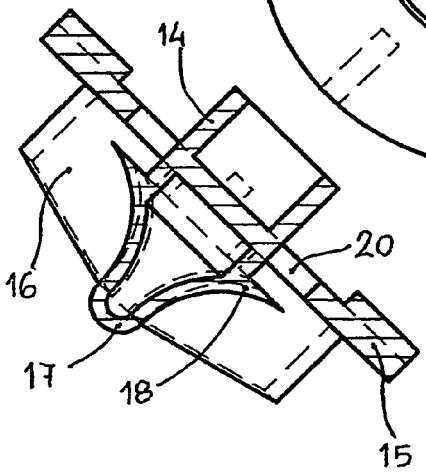
Figure 4:
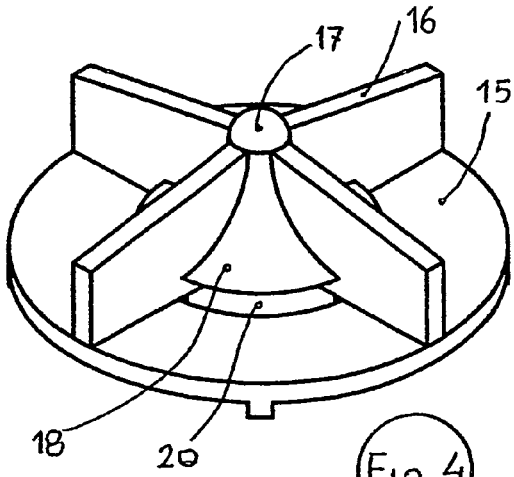

With reference to FIGS. 1 to 4, the centrifugal pump according to the present invention comprises a casing 10 which defines a chamber 11 provided with a water intake opening 12 and a water delivery opening 13.

Inside the chamber 11 there is mounted an impeller that is formed by a central hub 14 and a disk 15 provided with blades 16 which extend radially with respect to the hub. The blades 16 are provided integrally, i.e. in a single-piece construction with the disk 15 and extend from the surface thereof which is facing the intake side of the pump. The hub 14 extends towards the intake opening of the pump with a nose-piece 17 that has a skirt 18 which expands into a bell-like shape and is spaced from the surface of the bladed disk 15.

According to the present invention, the impeller is provided with at least a slit 20, which turns actually out as being provided in the central zone of the disk 15, between two contiguous blades. The slit or slits 20 are guarded by said expanded skirt 18 of the nose-piece 17, the curvature of which guides the flow of water from the centre towards the periphery of the impeller, while carrying with it any possible foreign matter, in particular lint, so as to prevent it from depositing onto the blades 16 or moving into clogging the slit 20.

As opposite to what actually occurs with the known prior-art impellers, the water does not pass through to the rear side of the impeller by flowing in some way or other through the body of the impeller itself, but flows on the front surface of the impeller, thereby creating a negative pressure on the rear surface thereof due to the presence of the afore cited slits 20. This negative pressure nullifies the axial thrust that might be generated on the disk of the impeller in the case of an occurrence of a direct passage of water from the front side to the rear side of the impeller.

It will of course be appreciated that the above described solution is effective in totally solving also the problem of the apertures in the impeller getting clogged and, as a result, offers additional advantages in terms of reduced maintenance requirements and wear and tear of the impeller.

In view of an improved balance of the impeller, the slits 20 are arranged in diametrically opposed pairs. Preferably, the blades 16 are in the number of four; the same applies to the slits 20 that are provided between contiguous blades.

Figure 5:
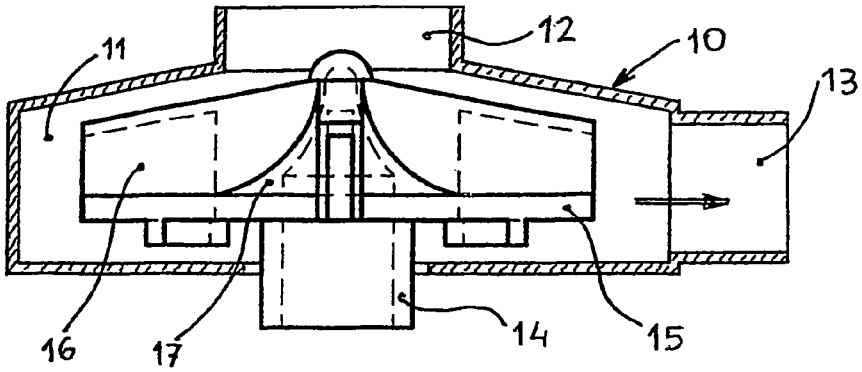
FIGS. 5 to 8 are similar views as the above cited ones of a second embodiment of a pump with an impeller that makes use of the same innovatory concept.
Figure 6:
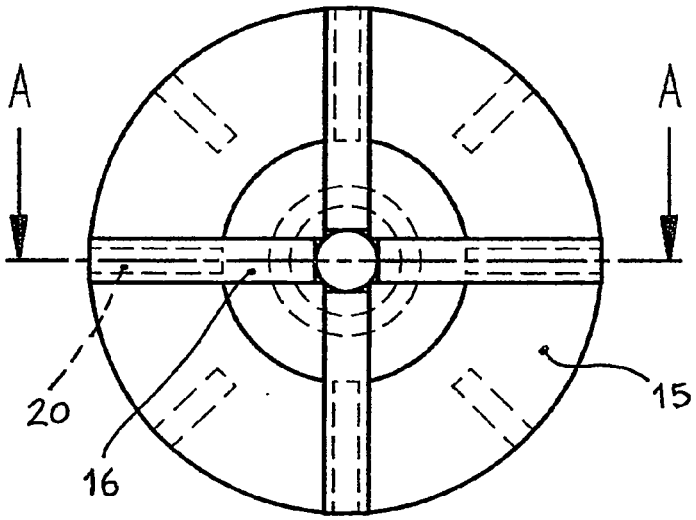
Figure 7:
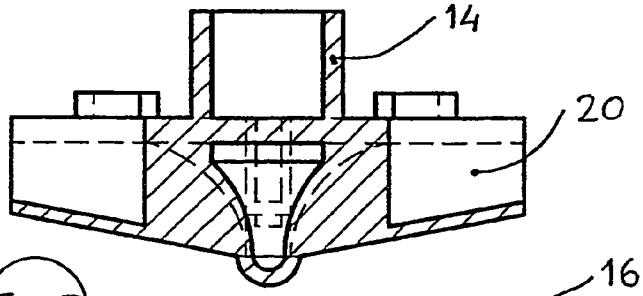
Figure 8:
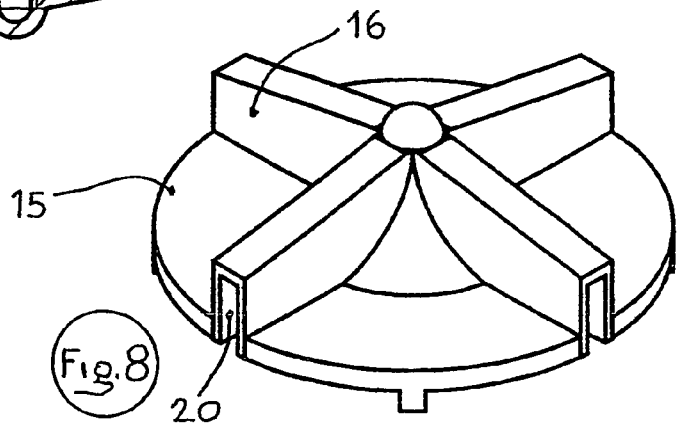

FIGS. 5 to 8 illustrate an alternative solution with respect to the previously described one, although it is based actually on the same innovatory concept, i.e. the basic idea of avoiding a direct passage of the water through the body of the impeller and causing a negative pressure to be created on the rear surface thereof, instead. Corresponding items and components of the two solutions, illustrated in the two series of Figures, are indicated with the same reference numerals. In particular, unaltered remain the reference numerals indicating the casing 10 of the pump, the hub 14, the disk 15 and the blades 16 of the impeller.

In this second embodiment, however, the disk 15 is solid, while the blades 16 have a body in a U-shaped conformation, the aperture of which is facing the rear side of the bladed disk 15, and the recess of the blades forms a respective slit 20. At the peripheral end portion of each slit 20, during the rotation of the bladed disk 15, a negative pressure is created which generates the same effect as the one produced by the slits described in connection with the first example of embodiment. The result that is in this way obtained, in terms of hydraulic balancing of the impeller, under annulment of the axial thrust upon the same impeller, as well as of avoidance of the clogging problem due to lint and foreign matters, corresponds to the one that has been already indicated in connection with the afore described embodiment.

The invention claimed is:

1. Centrifugal pump comprising: a casing (10) that defines a chamber (11) provided with a water intake aperture (12) and a water delivery aperture (13), and an impeller that is adapted to rotate within said chamber and is formed by a central hub (14) which extends axially towards the intake aperture (12) and a disk (15) provided with blades (16) extending radially with respect to central hub (14), the blades (16) extend from a surface of the disk (15) that faces the intake aperture (12) of the pump, said impeller is provided with at least a slit (20) adapted to generate a negative pressure on the rear surface of the bladed disk (15) during the rotation of the impeller, said blades having a U-shaped conformation with the aperture facing the rear side of the bladed disk (15), and the recess of the blades (16) forming a respective slit (20), characterized in that the disk (15) and the blades (16) forms a continuous surface extending radially from the central hub (14) so as to guide the flow of water from the center to the periphery of said impeller and prevent water from passing directly through the slit (20).

* * * * *